US005541614A

United States Patent [19]

Lam et al.

[11] Patent Number: 5,541,614

[45] Date of Patent: Jul. 30, 1996

[54] SMART ANTENNA SYSTEM USING MICROELECTROMECHANICALLY TUNABLE DIPOLE ANTENNAS AND PHOTONIC BANDGAP MATERIALS

[75] Inventors: Juan F. Lam, Agoura Hills; Gregory L. Tangonan, Oxnard; Richard L. Abrams, Pacific Palisades, all of Calif.

[73] Assignee: Hughes Aircraft Company, Los Angeles, Calif.

[21] Appl. No.: 416,621

[22] Filed: Apr. 4, 1995

[51] Int. Cl.[6] ..... H01Q 11/10

[52] U.S. Cl. ..... 343/792.5; 343/701; 343/754

[58] Field of Search ..... 343/700 MS, 701, 343/754, 815, 823

[56] References Cited

U.S. PATENT DOCUMENTS

| | | | |
|---|---|---|---|
| 2,505,115 | 4/1950 | Hills et al. | 343/823 |
| 3,276,023 | 9/1966 | Dorne et al. | 343/754 |
| 3,339,205 | 8/1967 | Smitka | 343/701 |
| 3,959,794 | 5/1976 | Chrepta et al. | 343/701 |
| 5,121,089 | 6/1992 | Larson | 333/107 |
| 5,146,233 | 9/1992 | Ursenbach | 343/815 |
| 5,293,172 | 3/1994 | Lamberty | 343/701 |
| 5,386,215 | 1/1995 | Brown | 343/792.5 X |

OTHER PUBLICATIONS

K. M. Ho et al., "Existence of Photonic Band Gap in Periodic Dielectric Structures,", Phys. Rev. Lett., vol. 65, No. 25, 17 Dec. 1990, pp. 3152–3155.

E. Yablonovitch, "Photonic Bandgap Structures," J. Opt. Soc. Am. B., vol. 10, No. 2, Feb. 1993, pp. 283–295.

"Design considerations for micromachined actuators," S. F. Bart et al., Sensors and Actuators 14, 269 (1988).

"Experimental study of electric suspension for microbearings," S. Kumar et al., J. Microelectromech. Systems 1, 23 (1992).

"Piezoelectric micromotors for microrobots," A. M. Flynn et al., J. Microelectromech. Systems 1, 44 (1992).

"Design considerations for a practical elecrostatic micro–motor," W. S. N. Trimmer et al., Sensors and Actuators 11, 189 (1987).

"Microactuators for GaAs–based microwave integrated circuits," by L. E. Larson et al., *Transducer '91*, Digest of the International Conference on Solid–State Sensors and Actuators, pp. 743–746.

"Radiation properties of a planar antenna on a photonic–crystal substrate," E. R. Brown et al., Journal of the Optical Society of America B, 10, 404–407 (1993).

"Donor and Acceptor Modes in Photonic Band Structure," E. Yablonovitch et al., Phys. Rev. Let. 67, 3380 (1991).

M. Mehregany et al., "Surface Micromachined Mechanisms and Micromotors", J. Micromech. Microeng. vol. 1, 73 (1991).

P. P. Deimel, "Micromachining Processes and Structures in Micro–optics and Optoelectronics," J. Micromech. Microeng., vol. 1, 199 (1990).

*Primary Examiner*—Donald T. Hajec
*Assistant Examiner*—Tho Phan
*Attorney, Agent, or Firm*—V. D. Duraiswamy; W. K. Denson-Low

[57] ABSTRACT

An antenna system includes a set of symmetrically located center-fed and segmented dipole antennas embedded on top of a frequency selective photonic bandgap crystal. A two-dimensional array of microelectromechanical (MEM) transmission line switches is incorporated into the dipole antennas to connect the segments thereof. An MEM switch is located at the intersection between any two adjacent segments of the antenna arm. The segments can be connected (disconnected) by operating the switch in the closed (open) position. Appropriate manipulation or programming of the MEM switches will change the radiation pattern, scanning properties and resonance frequency of the antenna array. In addition, an MEM switch is inserted into the crystal to occupy a lattice site in the 3-dimensional crystal lattice. The crystal will have a broadband stopgap if the MEM switch operates in the closed position (perfect symmetry of the crystal), and will produce a narrowband absorption line inside the stopgap if the MEM switch is in the open position, thereby permitting change in real time of the frequency response of the crystal.

19 Claims, 2 Drawing Sheets

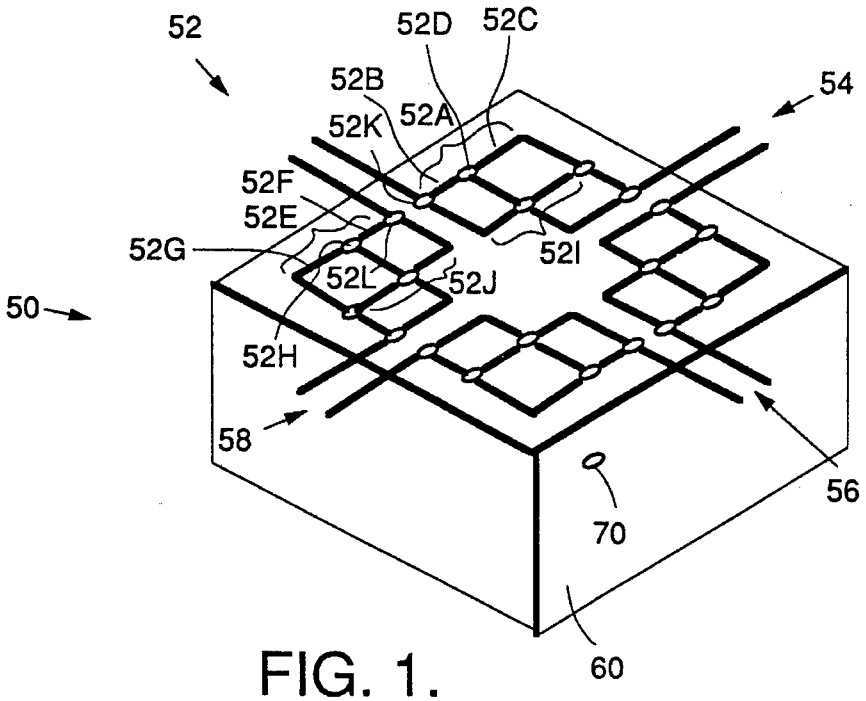
FIG. 1.
FIG. 2.
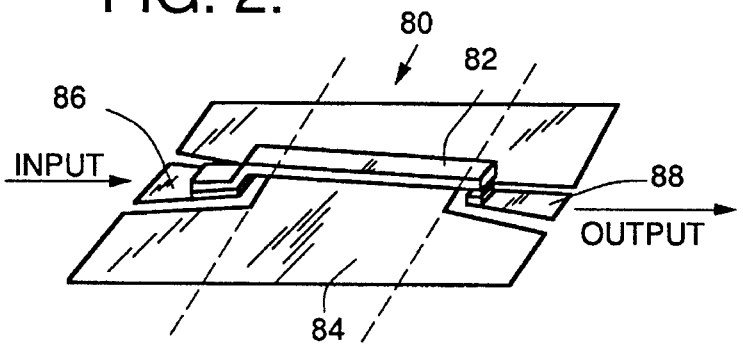
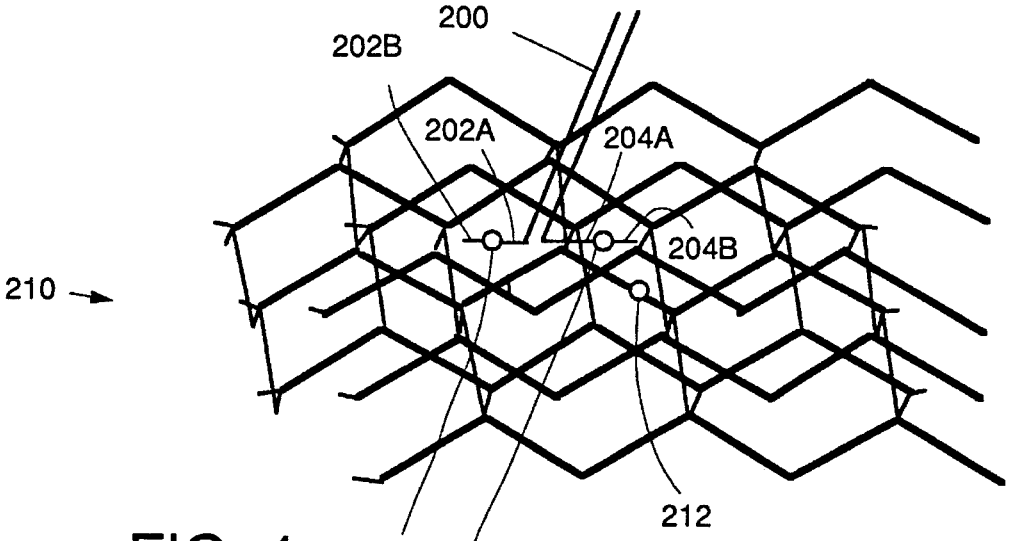
FIG. 4.

SMART ANTENNA SYSTEM USING MICROELECTROMECHANICALLY TUNABLE DIPOLE ANTENNAS AND PHOTONIC BANDGAP MATERIALS

BACKGROUND OF THE INVENTION

The present invention relates to antenna systems, and more particularly to an antenna system which is frequency agile, steerable, self-adaptable, programmable and conformal.

Antennas are widely utilized in microwave and millimeter-wave integrated circuits for radiating signals from an integrated chip into free space. These antennas are typically fabricated monolithically on III–V semiconductor substrate materials such as GaAs or InP.

To understand the problems associated with antennas fabricated on semiconductor substrates, one needs to look at the fundamental electromagnetic properties of a conductor on a dielectric surface. Antennas, in general, emit radiation over a well defined three-dimensional angular pattern. For an antenna fabricated on a dielectric substrate with a dielectric constant $\epsilon_r^{3/2}$. Thus, a planar antenna on a GaAs substrate ($\epsilon_r$=12.8) radiates 46 times more power into the substrate than into the air.

Another problem is that the power radiated into the substrate at angles greater than $$\Theta_c=\sin^{-1}\epsilon_r^{-1/2}$$

is totally internally reflected at the top and bottom substrate-air interfaces. In GaAs, for instance, this occurs at an angle of 16 degrees. As a result, the vast majority of the radiated power is trapped in the substrate.

Some of this lost power can be recovered by placing a groundplane (a conducting plane beneath the dielectric) one-quarter wavelength behind the radiating surface of the antenna. This technique is acceptable provided the antenna emits monochromatic radiation. In the case of an antenna that emits a range of frequencies (a broadband antenna), the use of a groundplane will not be effective unless the dielectric constant ($\epsilon_r$) has a 1/(frequency)$^2$ functional dependence and low loss. No material has been found that exhibits both the low loss and the required $\epsilon_r$ dependence over the large bandwidth that is desired for some antenna systems.

One way to overcome these problems is to use a three-dimensional photonic bandgap crystal as the antenna substrate. A photonic bandgap crystal is a periodic dielectric structure that exhibits a forbidden band of frequencies, or bandgap, in its electromagnetic dispersion relation. These photonic bandgap materials are well known in the art. For example, see K. M. Ho, C. T. Chan and C. M. Soukoulis, "Existence of Phontonic Band Gap in Periodic Dielectric Structures," Phys Rev. Lett. 67, 3152 (1990), and E. Yablonovitch, "Photonic Bandgap Structures," J. Opt. Soc. Am. B 10, 283 (1993).

The effect of a properly designed photonic bandgap crystal substrate on a radiating antenna is to eject all of the radiation from the substrate into free space rather than absorbing the radiation, as is the case with a normal dielectric substrate. The radiation is ejected or expelled from the crystal through Bragg scattering. This concept has been described in E. R. Brown, C. D. Parker and E. Yablonovitch, "Radiation Properties of a Planar Antenna on a Photonic-Crystal Substrate," J. Opt. Soc. Am. B 10, 404 (1993). However, these new materials have not been exploited in a manner that will provide frequency agility to any antenna system.

There have been a number of developments in the field of microelectromechanical ("MEM") engineering and photonic bandgap crystals. For example, an MEM transmission line switch is described in "Microactuators for GaAs-based microwave integrated circuits," by L. E. Larson, L. H. Hackett and R. F. Lohr, *Transducer* '91, Digest of the International Conference on solid-state sensors and Actuators, page 743–746. Techniques for fabricating micromotors are still in the development stages. Exemplary references include "Design considerations for a practical electrostatic micro-motor," W. S. N. Trimmer et al., Sensors and Actuators 11, 189 (1987); "Design considerations for micromachined actuators," S. F. Bart et al., Sensors and Actuators 14, 269 (1988); "Surface micromachined mechanisms and micromotors," M. Mehregany et al., J. Micromech. Microeng. 1, 73 (1991); "Micromachining processes and structures in micro-optics and optoelectronics," P. P. Deimel, J. Micromech. Microeng. 1, 199 (1991); "Experimental study of electric suspension for microbearings," S. Kumar et al., J. Microelectromech. Systems 1, 23 (1992); "Piezoelectric micromotors for microrobots," A. M. Flynn et al., J. Microelectromech. Systems 1, 44 (1992).

SUMMARY OF THE INVENTION

An antenna system is described which includes a set of symmetrically located center-fed and segmented dipole antennas embedded on top of a frequency selective photonic bandgap crystal. A two-dimensional array of microelectromechanical (MEM) transmission line switches is incorporated into the dipole antennas to selectively connect adjacent segments of the dipoles, and thereby select a desired dipole arm length, and dipole resonant frequency. An MEM switch is located at the intersection between any two adjacent segments of the antenna arm. The segments can be connected (disconnected) by operating the switch in the closed (open) position. Appropriate manipulation or programming of the MEM switches will change the radiation pattern, scanning properties and resonance frequency of the antenna array.

In accordance with a further feature of the invention, an MEM switch is inserted into the crystal to occupy a lattice site in the 3-dimensional crystal lattice. The crystal will have a broadband stopgap if the MEM switch operates in the closed position (perfect symmetry of the crystal), and will produce a narrowband absorption line inside the stopgap if the MEM switch is in the open position, thereby permitting change in real time of the frequency response of the crystal. Control of the pattern of the radiation sidelobes is achieved by choosing metal-based photonic crystals, whose properties are the inverse of those from a dielectric medium.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is an isometric view of an embodiment of an MEM antenna system embodying the invention.

FIG. 2 illustrates an MEM switch employed in the antenna system of FIG. 1.

FIG. 4 illustrates an alternative embodiment of the substrate of the system of FIG. 1, a 3-dimensional metallic wire lattice structure.

DETAILED DESCRIPTION OF THE PREFERRED EMBODIMENT

Figure 3:
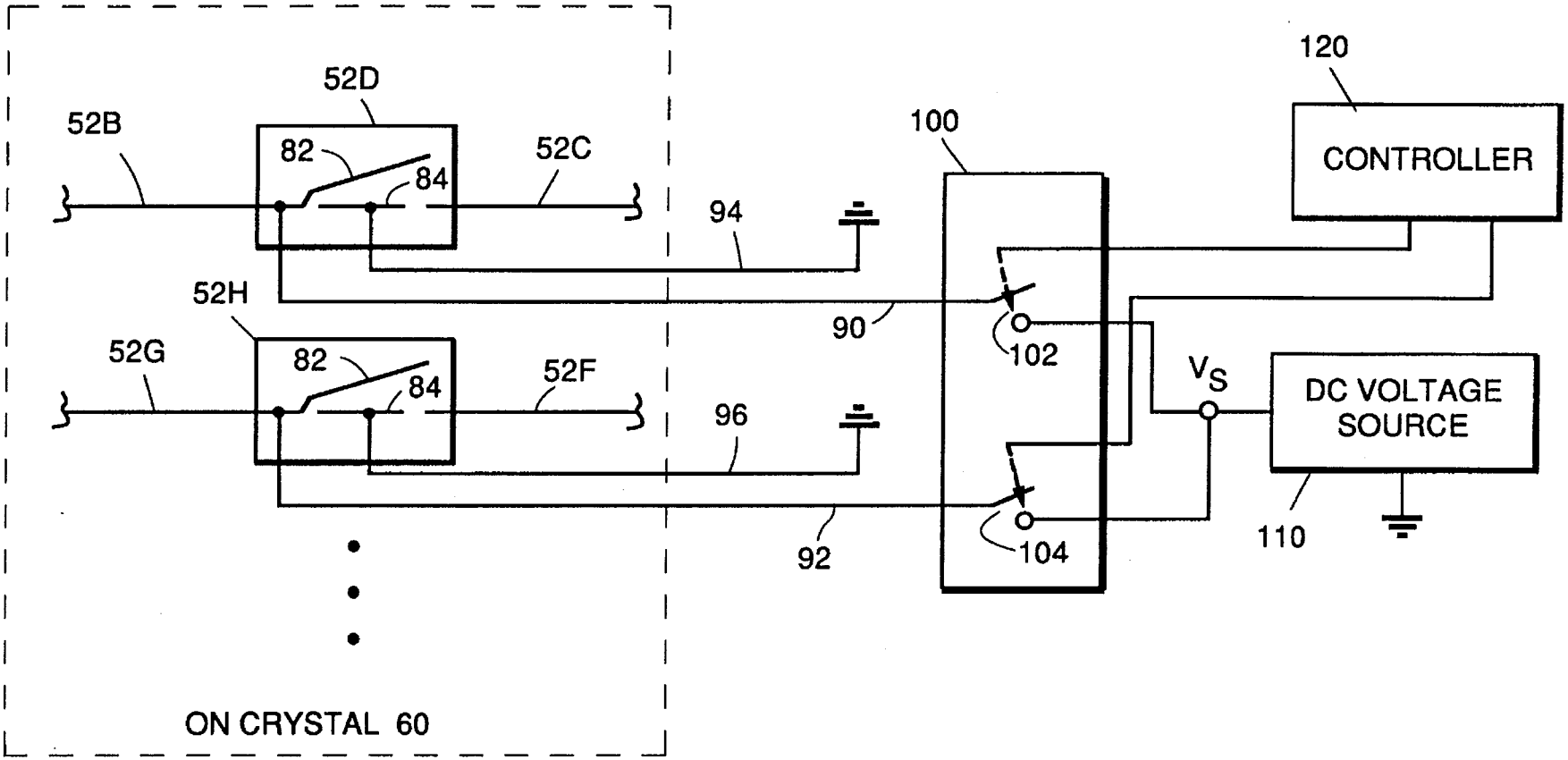
FIG. 3 is a simplified schematic diagram of a circuit arrangement for controlling the switch modes of the MEM switches comprising the system of FIG. 1.

An embodiment of an antenna system 50 embodying the invention is shown in simplified form in FIG. 1. This exemplary system comprises four symmetrically placed center-fed, multiple-arm, segmented dipole antennas 52, 54, 56, 58. Each antenna includes segments connected by corresponding MEM switches of the type shown in FIG. 2 as switch 80, discussed more fully hereinbelow. The entire system 50 is embedded on top of an MEM-controlled photonic crystal 60.

The photonic crystal 60 is a 3-dimensional array of macroscopic lattice sites with a specific translational symmetry, such as the diamond structure. The key advantage of using photonic crystals as the antenna substrate is to achieve enhanced radiation efficiency (to nearly 100 percent) over a specific frequency band. This property of photonic crystals surpasses present state-of-the-art antenna technologies, which are not capable of achieving high efficiency over a wide range of frequencies. An MEM switch is fabricated into one of the lattice sites. If the MEM switch operates in the "closed" mode, then the photonic crystal maintains its translational symmetry, and its passband characteristic is a stopband for radiation fields of a specific wavelength range. If the MEM switch operates in the "open" mode, then the photonic crystal loses its translational symmetry, leading to the appearance of a narrow absorption band located inside the stopband. Hence, by controlling the "open" or "closed" mode of operation of the MEM switch inside the photonic crystal, the passband characteristics of the photonic crystal can be changed in real time.

The crystal 60 can be fabricated of metallic or dielectric materials such as ceramics. Typical metallic materials suitable for the purpose include copper and aluminum. Typical dielectric ceramic materials suitable for the purpose include $Ba_2Ti_9O_{20}$, $Zr_{0.8}TiSn_{0.2}O_4$, $Ba[Sn_x(Mg_{1/3}Ta_{2/3})_{1-x}])O_3$.

In a general sense, the mode of the MEM switches will be controlled in real time in such a manner as to produce a desired radiation pattern and resonance frequency for the application at hand. For example, if one wants to direct the beam in a certain direction at a certain resonance frequency, than the MEM switches are operated uniformly along a specific direction. It is possible to change the radiation frequency by changing the dipole arm length by opening and closing the MEM switches, even in the absence of the photonic crystal. The only purpose of the photonic crystal is to enhance the radiation efficiency (to nearly 100 percent in some applications) as well as to provide selectively either a broad stopband or a narrow absorption band, depending on the specific materials.

Suppose that a dipole antenna has one MEM switch per dipole arm. If the MEM switch operates in the "closed-"mode, then the radiation wavelength of the antenna will be approximately equal to the full dipole length (sums of the lengths of the two arms). Should the MEM switch operate in the "open" mode, then the radiation wavelength of the antenna will be equal to approximately half of the initial full dipole length. However, the major problem arises that the present technology, based on standard dielectric materials plus a metallic ground plane, is incapable of providing equal radiation efficiency for both wavelengths.

The radiation emitted by the antenna propagates over a 4 pi steradian. For the case of a planar antenna disposed on a top surface of a dielectric substrate, the radiation is emitted into both the free space as well as the dielectric substrate. Since most of the radiation is emitted into the substrate, the present technology uses a standard dielectric material whose thickness is set at one quarter of the radiation wavelength, and a metallic ground plane that reflects the radiation back into the antenna. This technology relies on the concept that the reflected radiation will add up in phase with the transmitted radiation. Hence it lead to increased efficiency.

Consider the dipole antenna 52 comprising the system 50. Each arm of the antenna is divided into two segments each connected by an MEM switch. For example, arm 52A comprises segments 52B and 52C, joined by switch 52D. Arm 52E comprises segments 52F and 52G, joined by switch 52H. Moreover, arms 52I and 52J can be selected in place of arms 52A and 52E, respectively, by selecting the state of switches 52K and 52L. The purpose of selecting arms 52I and 52J is to produce a small antenna array within the modular MEM antenna system; many of these modular systems can be placed side by side in order to create a macroscopic phased array antenna. Thus, the length of the dipole antenna arms can be doubled (halved) by operating the MEM switch in the "closed" ("open") mode. The MEM switch can be constructed to have typical isolation of greater than 35 dB in the open mode, and less than 0.5 dB loss in the closed mode, over the range of 0.1–45 GHz. Hence, the radiation pattern and the resonance frequency of each dipole antenna can be altered in real time by operation of the MEM switches.

FIG. 2 is a schematic diagram illustrating an exemplary form of an MEM switch 80 suitable for use in the array 50 of FIG. 1. As shown therein, and more particularly described in Larson et al., "Microactuators for GaAs-Based Microwave Integrated Circuits," this type of switch is a cantilevered beam micromachined "bendable" switch. Applying a dc voltage between the beam 82 and the ground plane 84 closes the switch 80. Removing the voltage opens the switch. The switch input 86 and output 88 can be connected to the arms of the dipole antenna elements which are to be selectively connected together by the switch when in a closed position.

A two-dimensional array of MEM switches connecting the segmented dipole antennas will provide a real time steering capability and frequency agility by appropriate choices of MEM switch modes of operation. The switch modes are controlled by applying an external DC bias voltage. Impedance matched transmission lines, fabricated on the surface of the photonic crystal, connect the switches in the appropriate sequence for operation.

FIG. 3 is a simplified schematic diagram illustrating an exemplary circuit arrangement for controlling the MEM switches comprising the system 50; for simplicity only switches 52D and 52H are shown. Transmission lines 90 and 92 respectively connect the cantilevered beams 82 comprising the respective switches 52D and 52H to a switch 100 for selective connection to the DC switch voltage generated by the DC voltage source 110. Thus, switch 102 selectively connects the beam of switch 52D to the switch voltage, as controlled by controller 120. Switch 104 selectively connects the beam of switch 52H to the switch voltage, as controlled by controller 120. The ground planes 84 of each MEM switch 52D and 52H are connected to ground by transmission lines 94 and 96.

Besides dipole antennas as shown in FIG. 1, other types of antenna structures may be used in an antenna array in accordance with this invention. Examples include YAGIUDA antennas, log periodic antennas, helical antennas, spiral plate and spiral slot antennas. See, Constatine A. Balanis, "Antenna Theory: Analysis and Design," John Wiley and Sons Publishing Company, 1982.

The importance of the photonic bandgap substrates for antenna applications has recently been quantified in "Radiation properties of a planar antenna on a photonic-crystal substrate," E. R. Brown et al., id., wherein the radiation pattern of a planar antenna was measured, for the case of an antenna laying on top of a photonic bandgap substrate versus that of an antenna laying on top of a conventional solid dielectric. The effect of a properly designed photonic bandgap substrate on a radiating antenna is to reject all the radiation from the substrate into free space. This contrasts with the case of a typical solid dielectric substrate, which absorbs much of the radiation emitted by the antenna.

Manufacturing methods for photonic bandgap crystals are well known in the art. For example, see E. Yablonovitch, "Photonic Bandgap Structures," J. Opt. Soc. Am. B 10, 183 (1993). One method is to cover the dielectric material with a mylar mask that consists of an equilateral triangular array of holes. The mask can be held in place by an adhesive. The spacing between the holes on the mask defines the lattice spacing. The midband frequency of the photonic bandgap crystal is determined by the lattice spacing. More specifically, the midband frequency of the photonic bandgap crystal is one-half the lattice spacing, therefore, the mask should be designed with a specific midband frequency in mind so that the holes on the mask can be spaced appropriately. Once the mask is in place on the dielectric material, three drilling operations are conducted through each hole. The drilling operations are conducted 35 degrees of normal incidence and spread out 120 degrees on the azimuth with respect to each other. The resulting criss-cross of holes below the surface of the dielectric material produces a fully three-dimensional periodic face-centered cubic structure. This structure is comprised of two interpenetrating face-centered cubic Bravais lattices. The drilling can be done by a real drill bit for a photonic bandgap crystal that is designed for microwave frequencies or by reactive ion etching for a crystal that is designed for optical frequencies. The diameter of the drilled holes determines the volumetric ratio of air holes to dielectric material remaining after the drilling operation.

It has been demonstrated that an imperfection, i.e., a symmetry break, in the photonic bandgap lattice could give rise to an absorption line inside its stopgap. "Donor and Acceptor Modes in Photonic Band Structure," E. Yablonovitch et al., Phys. Rev. Lett. 67, 3380 (1991); FIGS. 3(*a*)–3(*c*) of this paper respectively plot the transmissivity of a photonic crystal as a function of frequency for a defect-free photonic crystal, an imperfect (single acceptor) crystal, and an imperfect (single donor defect). This phenomenon is exploited in accordance with the invention by fabricating an MEM transmission line switch into the photonic bandgap substrate such that the frequency passband characteristics of the substrate can be altered by the mode of operation of the switch. That is, the MEM switch in the "closed" mode of operation will produce a wideband stopgap, and will produce a frequency selective narrow band absorption line in the "open" mode of operation. Thus, MEM switch 70 is inserted into the crystal 60 such that the switch 70 occupies a lattice site in the 3-dimensional lattice of the crystal 60. A lattice site is a physical location which obeys the principle of translational symmetry.

The following procedure for inserting the MEM switch 70 into the photonic crystal can be employed. The rejection of radiation fields operating inside the stopgap is approximately 10 dB per each period of the photonic crystal lattice. Thus, to attain, say, a 30 dB rejection, one needs only three periods of the lattice. The procedure involves the mechanical or chemical drilling of holes into a solid layer of dielectric material of thickness equal to one period, and then the stacking of three layers on top of each other. Each layer is a photonic crystal of one lattice period. In order to achieve a 30 dB rejection, a stack of three layers is used. The MEM switch is inserted into the middle stack in the following manner. During the drilling process, a lattice site is selectively overlooked, i.e., an additional hole is drilled into the crystal in order to accommodate the MEM switch, leading to a discontinuity in the lattice symmetry. A metallic switch, along with the transmission line, is fabricated on the discontinuity. When the switch is operated in the "closed" mode, the discontinuity disappears. On the other hand, when the switch is operated in the "open" mode, a discontinuity will appear.

The crystal 60 will have a broadband stopgap if the MEM switch 70 operates in the closed position (perfect symmetry of the crystal), and will produce a narrowband absorption line inside the stopgap if the MEM switch is in the open position. Hence, the frequency response of this feature enhances the frequency selectivity and agility of the antenna system. The narrow absorption band reduces the wideband capability, but only in a selective manner. Important applications of such a result will be in IFF (Identification Friend or Foe) applications, stealth and jamming systems.

The agility and frequency selectivity are enhanced by the operation of the MEM switch 70 located inside the photonic crystal 60. One can essentially go from broad band to narrow band behavior in either transmit or receive mode of operation of a phased array antenna system employing this invention.

In an alternative embodiment, the photonic material substrate can be replaced with a set of 3-dimensional metallic wires forming a metallic photonic crystal 210, illustrated in FIG. 4. Such a metallic crystal substrate is described in commonly assigned co-pending application Ser. No. 08/416,625, filed concurrently herewith, entitled "Method and Apparatus for Producing a Wire Diamond Lattice Structure for Phased Array Side Lobe Suppression," by Joseph L. Pikulski and Juan F. Lam, the entire contents of which are incorporated herein. In this case, the metallic crystal substrate 210 will have properties that are similar to that of the dielectric photonic crystal illustrated in FIG. 1. In FIG. 4, an exemplary center-fed dipole antenna 200 lies on top of the metallic photonic crystal 210. For simplicity, only a single antenna is shown on the crystal, although a plurality of antennas may be employed, depending on the particular application. The antenna 200 includes segmented elements connected by MEM switches as in the embodiment of FIG. 1. Thus, dipole arm segments 202A and 202B are selectively coupled together by MEM switch 206. Dipole arm segments 204A and 204B are selectively coupled together by MEM switch 208. The metallic photonic crystal 210 also contains a MEM switch 212. The purpose of the MEM switch 212 in the photonic crystal 210 is to change its radiation properties in the same manner as switch 70 is employed in changing the radiation properties of the dielectric photonic crystal 60 of FIG. 1.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A high frequency antenna system, comprising:

a photonic bandgap substrate providing a three-dimensional array of lattice sites arranged with a particular translational symmetry, the structure having a radiation stop band for radiation fields of a wavelength range within the radiation stop band;

a plurality of segmented antenna elements defined on said substrate, each said antenna element comprising a plurality of adjacent segments;

a set of microelectromechanical (MEM) transmission line switches having respective opened and closed modes of operation for selectively connecting adjacent antenna element segments to vary the effective electrical length of selected portions of said antenna elements;

a lattice site MEM switch occupying a lattice site in said three-dimensional lattice, wherein said lattice site MEM switch has a first mode which maintains the translational symmetry of the substrate and wherein the substrate has a passband characteristic which is a stop band for radiation fields within the wavelength range, and a second mode wherein the substrate does not maintain its translational symmetry and has an absorption line within the stop band; and means for controlling said MEM switches to control said mode of operation to obtain a desired antenna system radiation pattern and to change a frequency response of said substrate.

2. The antenna system of claim 1 wherein said plurality of segmented antenna elements comprise symmetrically placed, center-fed, multiple-arm, segmented dipole antennas, and wherein said MEM switches can be controlled to select a desired arm length.

3. The antenna system of claim 2 wherein each said dipole antenna is characterized by a resonant frequency, and said MEM switches may be controlled to vary said resonant frequency in a desired manner.

4. The antenna system of claim 1 wherein said substrate comprises a metal-based photonic crystal.

5. The antenna system of claim 1 wherein said lattice site MEM switch comprises an apparatus for changing in real time a frequency response of said substrate.

6. The antenna system of claim 1 wherein said substrate comprises a three-dimensional wire lattice structure.

7. The antenna system of claim 1 wherein said photonic substrate is a dielectric substrate.

8. The antenna system of claim 7 wherein dielectric substrate is fabricated from a ceramic dielectric material selected from the group consisting of $Ba_2Ti_9O_{20}$, $Zr_{0.8}TiSn_{0.2}O_4$, $Ba[Sn_x(Mg_{1/3}Ta_{2/3})_{1-x}])O_3$.

9. A high frequency antenna system, comprising:

a stop band structure having a three-dimensional array of macroscopic lattice sites with a particular translational symmetry, the structure having a radiation stop band for radiation fields of a wavelength range within the radiation stop band, wherein the structure rejects radiation fields within the wavelength range;

a plurality of segmented antenna elements supported on a surface of said stop band structure, each said antenna element comprising a plurality of adjacent segments;

a set of microelectromechanical (MEM) transmission line switches embedded on the stop band structure and having respective opened and closed modes of operation for selectively connecting adjacent antenna element segments to vary the effective electrical length of selected portions of said antenna elements; and means for controlling said MEM switches to control said mode of operation to obtain a desired antenna system radiation pattern, wherein the means for controlling the MEM switches is operable to set the MEM switches in a first mode wherein the antenna system has a first operating wavelength, and in a second mode wherein the antenna system has a second operating wavelength, both the first and second wavelengths within said wavelength range, and wherein the antenna system radiation efficiency in the first mode is substantially equal to the antenna system radiation efficiency in the second mode due to the stop band characteristic of the stop band structure.

10. The antenna system of claim 9 wherein said plurality of segmented antenna elements comprise one or more symmetrically placed, center-fed, multiple-arm, segmented dipole antennas, and wherein said MEM switches can be controlled to select a desired arm length.

11. The antenna system of claim 10 wherein each of said one or more dipole antennas is characterized by a resonant frequency, and said MEM switches may be controlled to vary said resonant frequency in a desired manner.

12. The antenna system of claim 9 wherein said stop band structure is a frequency selective photonic crystal substrate.

13. The antenna system of claim 12 further comprising an MEM switch occupying a lattice site of said crystal substrate, and wherein said crystal has a broadband stopgap when said lattice site MEM switch is operated in a closed position, and has a narrowband absorption line inside said stopgap when said lattice site MEM switch is operated in an open position.

14. The antenna system of claim 13 wherein said lattice site MEM switch comprises apparatus for changing in real time a frequency response of said crystal.

15. The antenna system of claim 12 wherein said photonic crystal substrate is a dielectric substrate.

16. The antenna system of claim 15 wherein dielectric substrate is fabricated from a ceramic dielectric material selected from the group consisting of $Ba_2Ti_9O_{20}$, $Zr_{0.8}TiSn_{0.2}O_4$, $Ba[Sn_x(Mg_{1/3}Ta_{2/3})_{1-x}])O_3$.

17. The antenna system of claim 9 wherein said stop band structure is a three-dimensional wire lattice structure.

18. The antenna system of claim 9 wherein the first wavelength is one half the second wavelength.

19. The antenna system of claim 9 wherein the MEM transmission line switches include cantilevered beam micromachined bendable switches, wherein applying a dc voltage between the cantilevered beam closes the switch by bending the beam, and wherein the beam is in an open position in the absence of the dc voltage.

* * * * *